US005143432A

United States Patent [19]

Ohshima et al.

[11] Patent Number: 5,143,432

[45] Date of Patent: Sep. 1, 1992

[54] MECHANISM FOR CONTROLLING THE TRAVEL OF A STRUCTURAL MEMBER

[75] Inventors: Kazuyoshi Ohshima; Seiichiro Tamura, both of Tokyo, Japan

[73] Assignee: Sugatsune Industrial Co., Ltd., Tokyo, Japan

[21] Appl. No.: 704,413

[22] Filed: May 23, 1991

[30] Foreign Application Priority Data

May 23, 1990 [JP] Japan ..... 2-133140

[51] Int. Cl.[5] ..... A47B 88/00

[52] U.S. Cl. ..... 312/319.1; 312/334.17

[58] Field of Search ..... 312/319, 333, 348, 344.1; 384/19, 20, 21

[56] References Cited

U.S. PATENT DOCUMENTS 5,004,306 4/1991 Oshida .

5,020,868 6/1991 Brunnert ..... 312/333

*Primary Examiner*—Joseph Falk

*Attorney, Agent, or Firm*—Fleit, Jacobson, Cohn, Price, Holman & Stern

[57] ABSTRACT

According to the invention, there is provided an ingenuously contrived mechanism for controlling the travel of a movable structural member along rails comprising a pair of traveler devices removably engaged with the respective rails and a pair of travel controller that dampen the force pulling the movable member back into the fixed member. With such devices, the movable member can be easily separated from and returned to the fixed member that houses it without requiring any particular operation. Such a mechanism is particularly suited for a cabinet drawer.

3 Claims, 7 Drawing Sheets

MECHANISM FOR CONTROLLING THE TRAVEL OF A STRUCTURAL MEMBER

BACKGROUND OF THE INVENTION

1. Technical Field

This invention relates to a mechanism for controlling the travel of a structural member to be suitably used for a drawer.

2. Background Art

A known conventional drawer cabinet comprises a cabinet frame having one or more than one compartments, a pair of fixed rails arranged on each compartment, a pair of sliding rails for slidingly traveling on a corresponding pair of fixed rails and a drawer arranged on each pair of sliding rails as well as a pair of coil springs arranged for each pair of fixed rails to impart a force to the corresponding pair of sliding rails to regain their original position and a lock device for locking a corresponding drawer against the resilient force of spring in such a manner that the drawer may be automatically returned to the compartment by means of said springs once the lock device is released. (See Japanese Utility Design Disclosures Jikkai Shou No. 64-43743 and No. 64-43744.)

With a known drawer cabinet having a configuration as described above, an end of each spring is securely fitted to the cabinet frame by winding it around a hook arranged on the cabinet frame and the other end is fitted to a corresponding drawer so that it may be resiliently expanded as the drawer is pulled away from the compartment. With such an arrangement, the drawer cannot be completely removed from the cabinet frame, making it difficult to clean the inside and any hauling movement of a loaded and stuffed cabinet a very cumbersome operation. Moreover, the operation of assembling the cabinet requires time and labor as the fixed and sliding rails need to be fitted to the compartment and drawer respectively with the springs bound to the fixed and sliding rails.

Moreover, the speed of the drawer for automatically returning to the retracted position is not adjustable nor controllable and therefore it may require a constant load spring which is very expensive, if the speed for automatic return should be kept constant, making the choice of the spring member very limited.

In view of these and other problems of existing drawer cabinets, it is therefore the object of the present invention to solve the problems by providing a mechanism for controlling the travel of a movable member of a drawer cabinet that allows the movable member to freely travel within a predetermined range of movement relative to a matching fixed member, to be automatically returned to a retracted position by a spring means and, whenever necessary, to be completely separated from the fixed member and readily put back to its proper position, wherein the speed of said movable member is adjustable and controllable and said range of movement of the movable member can be freely selected by a lock device.

SUMMARY OF THE INVENTION

According to the invention, the above object of the invention is achieved by providing a mechanism for controlling the travel of a movable structural member along rails comprising a fixed member provided with a pair of fixed rails and a pair of sliding rails engaged with the respective fixed rails and a movable member arranged on said sliding rails, wherein it further comprises a pair of traveler devices removably engaged with the respective fixed rails, a pair of spring means for pulling the respective traveler devices in a given direction, a pair of travel controllers each comprising at least two rollers, the outer peripheries of said rollers being frictionally contacted with each other and the oppositely arranged respective inner surfaces of the corresponding fixed rail, and a pair of lock devices each comprising a lock plate capable of being releasably coupled with the corresponding sliding rail to rotate around a pivot, said lock devices being capable of securely holding the respective traveler devices to the fixed rails by means of the rotation of said lock plates at the time of coupling with the respective sliding rails, said rollers being pushed against said inner surfaces with sufficient friction generated therebetween to cause the travel controllers to function as dampers that dampen the pulling force of the spring means only when said traveler devices are pulled back into the fixed member as the sum of the diameters of the two rollers is so determined that it is greater than the distance between the opposite inner surfaces of the fixed rails.

With such an arrangement, when the sliding rails are engaged with the respective lock plates to couple the movable member and the traveler devices, the movable member is urged to move in a direction by the spring means arranged in the traveler devices until it automatically reach a predetermined position and stop there.

When the movable member is pulled in the other way, it is moved away from the fixed member with the traveler devices along the fixed rails against the pulling force of the spring means until it reaches another predetermined position, where the force pulling it out of the fixed member is transmitted to the lock plates by way of the respective sliding rails so that the lock plates are rotated in a predetermined direction to activate the lock means to hold the traveler devices there and release the sliding rails from the respective lock plates.

Thereafter, the movable member can be effortlessly pulled away from the fixed member to separate the fixed rails from the respective sliding rails and therefore itself from the fixed member.

Thereafter, movable member can be put back into the fixed member simply by bringing the fixed rails into engagement with the respective sliding rails and pushing the movable member into the fixed member. As the movable member is pushed into the fixed member, the sliding rails eventually abut the respective lock plates to rotate the latter in the other direction and couple the sliding rails and the lock plates, when the traveler devices are released from the locked condition.

Now, the traveler devices are pulled away in the opposite direction by the pulling force of the spring means to return to the initial positions so that the movable member is also returned to the initial position as it is pulled by the traveler devices.

When the movable member is pulled out of the fixed member, the rollers of the travel controllers of the traveler devices are moved in the opposite direction so that the extreme portions of their outer peripheries are no longer pressed against the opposite inner surfaces of the fixed rails. On the other hand, when the movable member is pulled back into the fixed member by the pulling force of the spring means, the rollers are moved in the direction opposite to the movement of the moving member so that the extreme portions of their outer peripheries are strongly pressed against the opposite inner surfaces of the fixed rails.

If said travel controllers are so designed as to contain a highly viscous fluid to function as so many dampers by the shearing drag of the fluid, the rotation of said rollers is braked by the dampers to slow down the moving speed and smoothen the movement of the movable member and the traveler devices. Therefore, simple coil springs may well be used as spring means and costly constant load springs may not be required.

Now, the present invention will be described in greater detail by referring to the accompanying drawings that illustrate a preferred embodiment of the invention.

DETAILED DESCRIPTION OF THE INVENTION

Figure 1A:
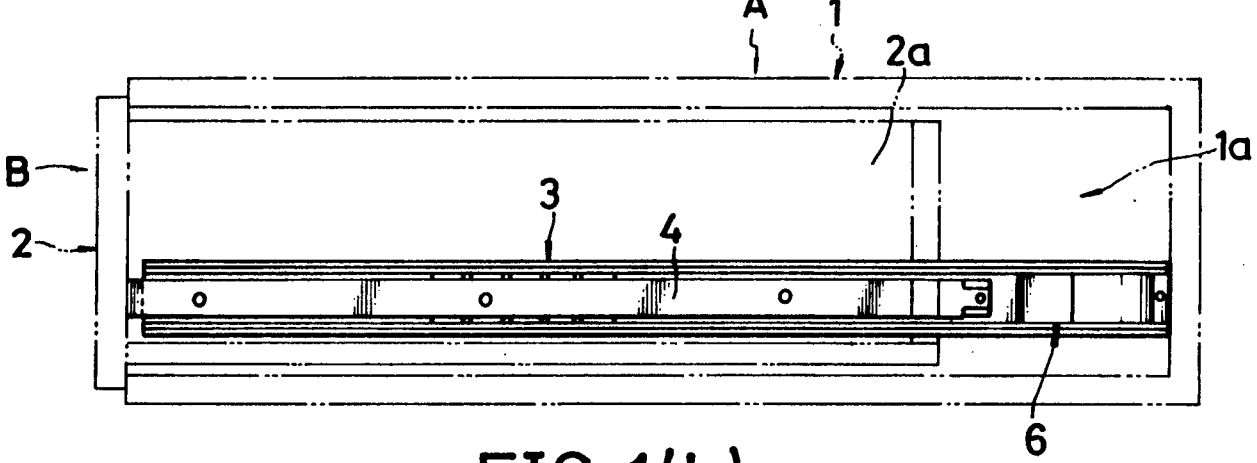
FIGS. 1(*a*) and 1(*b*) are side views of a preferred embodiment of the invention showing, respectively, when the movable member is completely housed in the fixed member and when the movable member is fully drawn out of the fixed member.
Figure 1B:
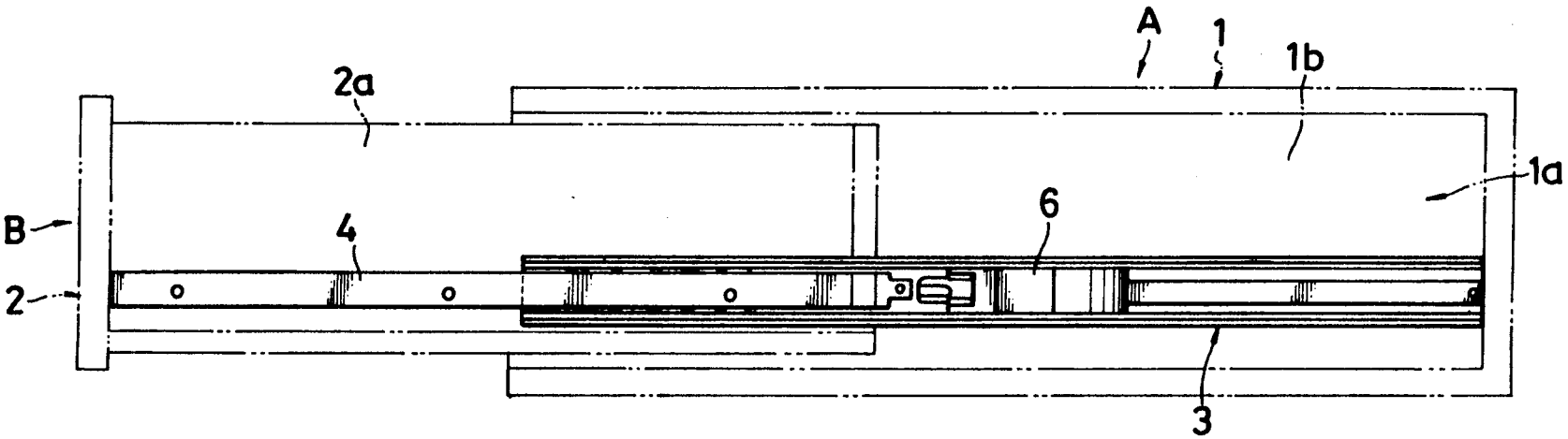
Figure 2:
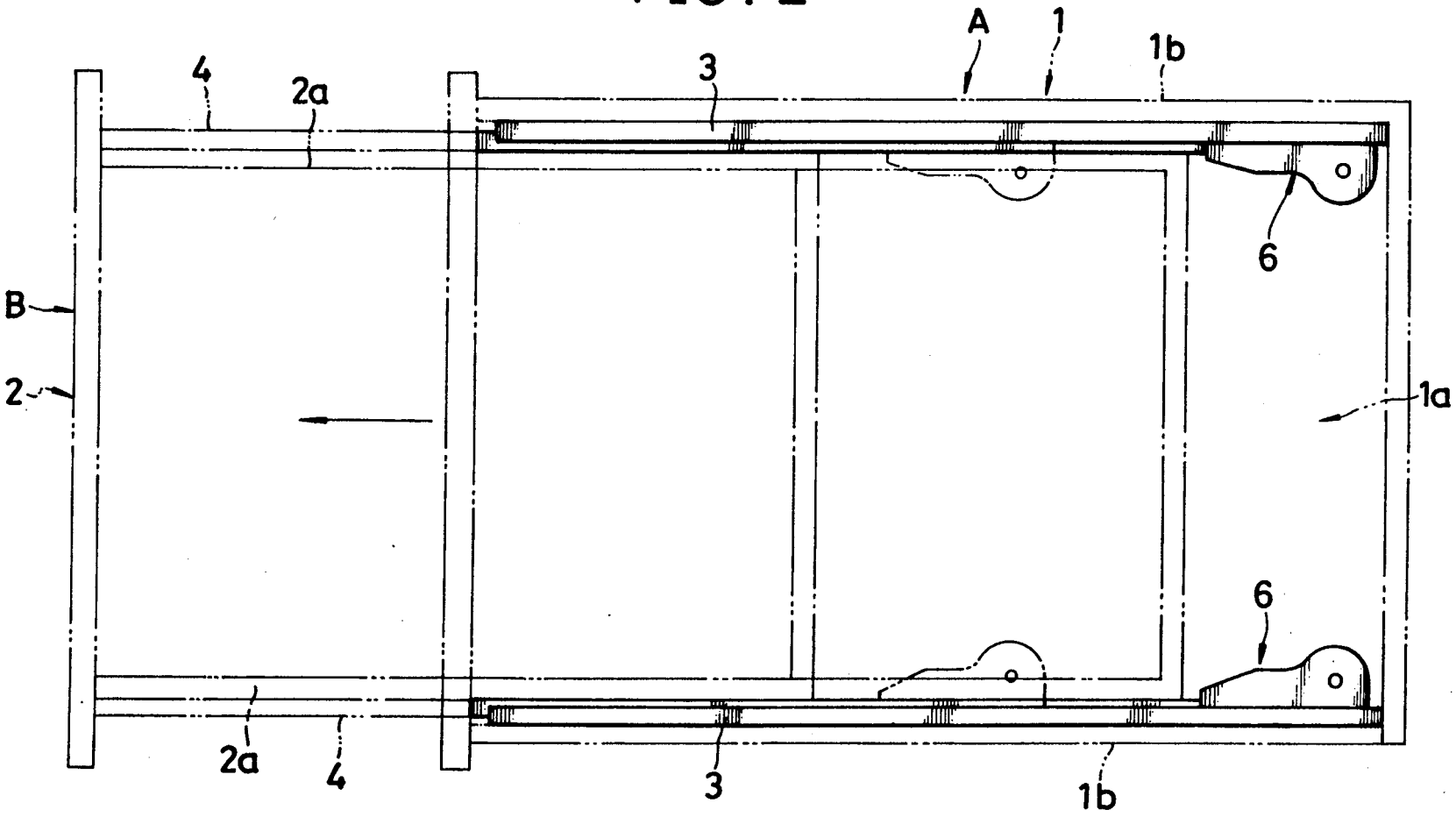
FIG. 2 a plan view of the embodiment showing the two extreme positions of the movable member.

In FIGS. 1*a*, 1*b*and 2, reference symbol A generally denotes a fixed member realized in the form of a rectangular cabinet frame 1 comprising a number of compartments 1*a* of which only one is shown, and left and right side panels 1*b*, of which only one is shown. A pair of longitudinal fixed rails 3, 3 are arranged horizontally and in parallel relative to each other in the compartment 1*a* on the respective inner surfaces of the side panels 1*b*, 1*b*.

Reference symbol B denotes a movable member realized in the form of a drawer 2 housed in the compartment 1*a* and provided with a pair of longitudinal and horizontal sliding rails 4, of which only one is shown, arranged on respective side panels 2*a*, 2*a* of the drawer. Thus, said drawer 2 is movably housed in said compartment 1*a* by means of said fixed rails 3, 3 and said sliding rails 4, 4.

Figure 4:
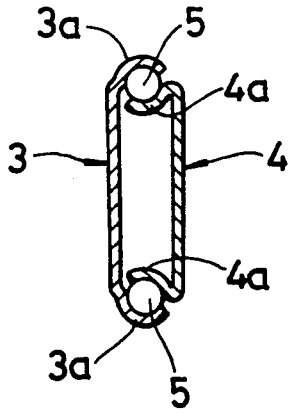
FIG. 4 is a sectional view of one of the fixed rails and the corresponding sliding rail.

The rails 3, 3, and the corresponding sliding rails 4, 4 are so configured that they have a pair of matching round conduits 3*a*, 3*a* and 4*a*, 4*a* (see FIG. 4) laterally projecting from the respective upper and lower ends to form a pair of longitudinal and cylindrical spaces arranged at the upper and lower ends for containing a number of steel balls 5 of a given size so that the sliding rail may freely slide along the fixed rail.

Figure 3:
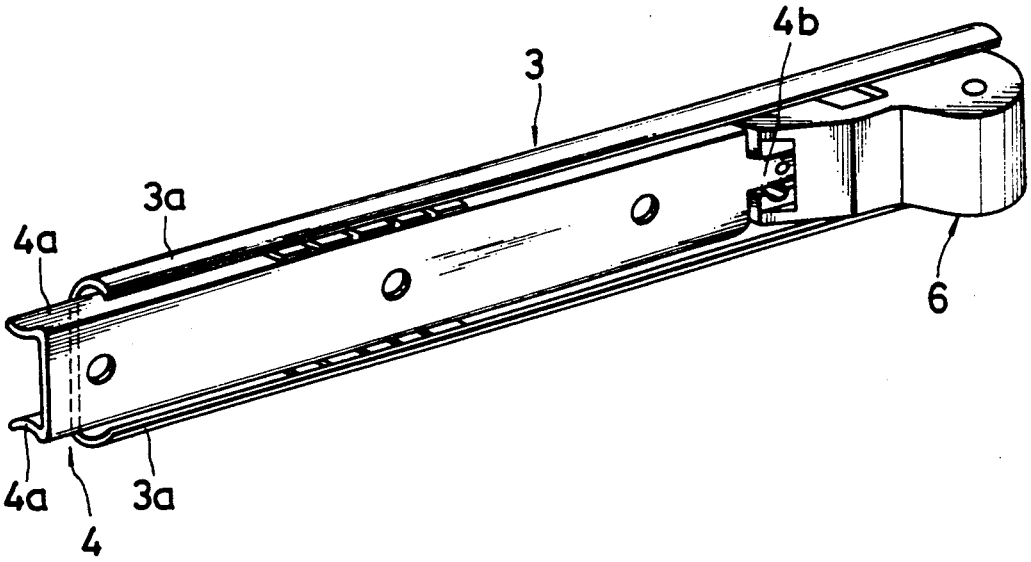
FIG. 3 is a perspective view of the embodiment showing only one of the fixed rails and the corresponding sliding rail and the traveler device.

A pair of traveler devices 6, 6 (see FIG. 3) are movably engaged with the respective fixed rails 3, 3 in such a manner that said traveler devices 6, 6 are constantly pulled by respective spring means 7, 7 (shown in FIGS. 5 and 6) in the direction for returning into the compartment 1*a*. Each of said traveler devices 6, 6 is provided with a travel controller 8 for controlling the movement of the traveler device 6 in a manner as described later and a lock device 9 for locking said traveler device 6.

Said traveler device 6 is prepared by assembling a main body 6*a* and a cover 6*b* (FIGS. 6–9), which is provided at its upper and lower end with a pair of projections 6*c*, 6*c* to be received by the respective conduits 3*a*, 3*a* of the fixed rail 3 so that the traveler device 6 may be slidable along the fixed rail 3 in the direction of pulling out the drawer 2 as well as in the direction of returning it into the compartment 1*a*.

Each of said spring means 7 is realized in the following manner.

A bobbin 11 (FIGS. 6 and 8) is arranged within the corresponding traveler device 6 near its rear end and rotatably supported by a horizontal rotary shaft 10. A belt-like constant load spring 12 is wound around the bobbin 11 with its one end 12*a* extended outwardly and backwardly from the traveler device 6 and rigidly fitted to the rear end of the fixed rail 3 by means of a screw 13 so that, as the traveler body 6 is pulled out along the fixed rail 3, said constant load spring 12 is unwound from the bobbin 11 to impart the traveler body 6 a force to return inside the compartment by the resilience of the spring trying to go back around the bobbin 11.

Said travel controller 11 is configured in the following way.

Figure 10:
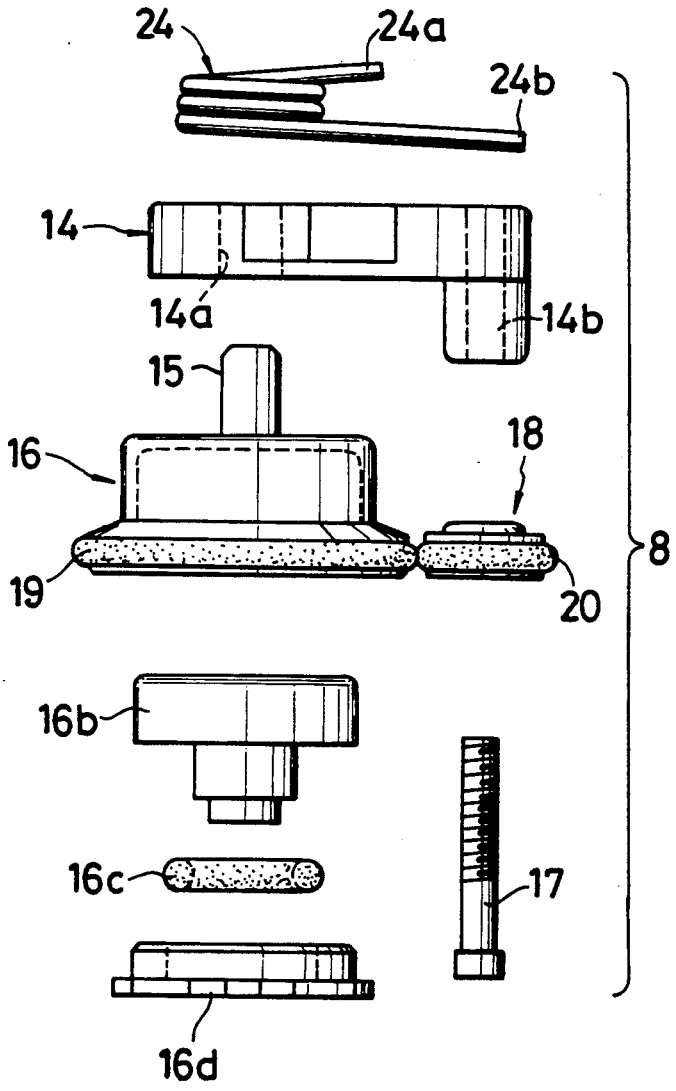
FIG. 10 is an exploded elevational view of one of the travel controllers of the embodiment.
Figure 11:
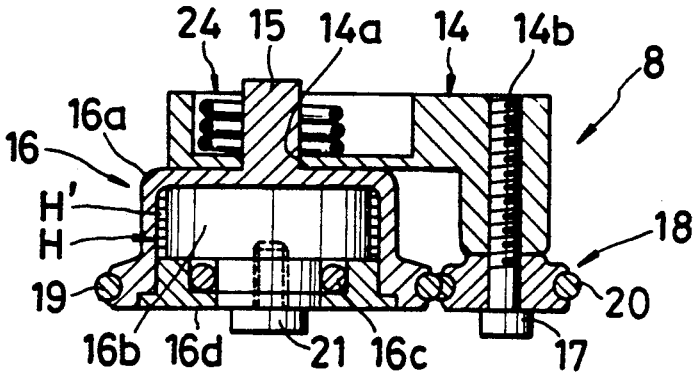
FIG. 11 is a sectional view of the travel controller of FIG. 10 showing the assembled state.

As shown in FIGS. 10 and 11, a bored bearing 14*a* of a catch 14 receives in it a shaft 15 rigidly fitted to a large diameter roller 16 so that the latter is rotatable relative to the catch 14, while another bored bearing 14*b* of the catch 14 receives a stepped and knurled pin 17, which rotatably carries a small diameter roller 18.

Figure 6:
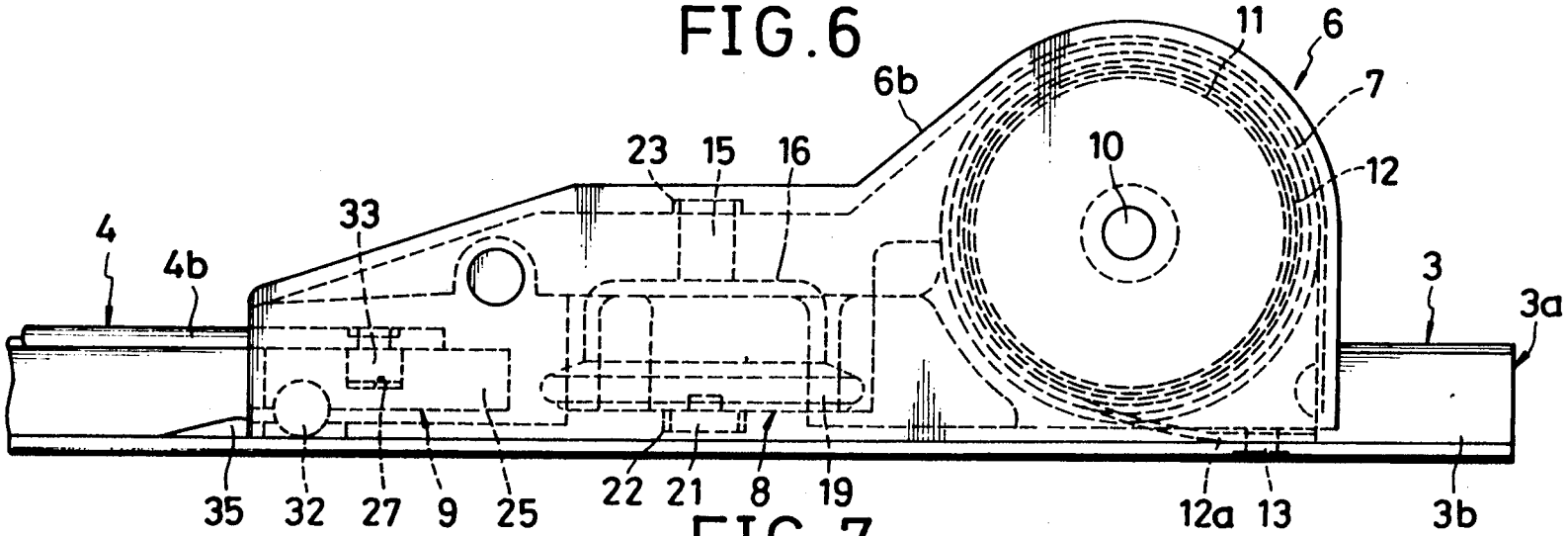
FIG. 6 is a partial side view corresponding to FIG. 5.
Figure 7:
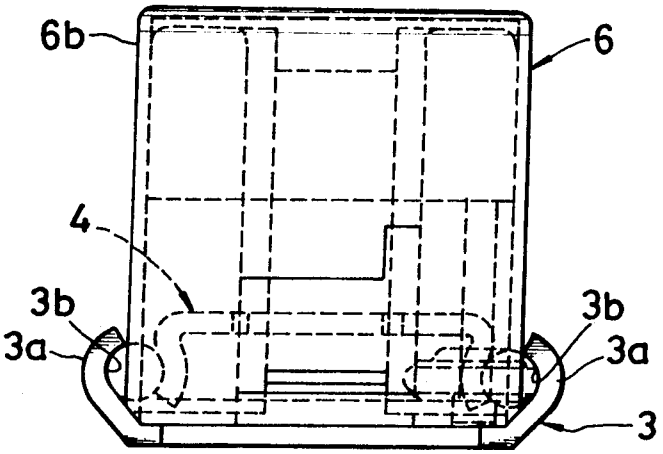
FIG. 7 is a rear view corresponding to FIG. 5.

Said rollers 16 and 18 are provided on their outer peripheral surfaces with respective anti-slip rings 19 and 20 made of a frictional material such as rubber and brought to frictional contact with each other so that, when a machine bolt 21 for securing roller lid 16*d* to be described later and said shaft 15 are rotatably and longitudinally slidably received by respective oblong slots 22 and 23 arranged respectively on the inside of the main body 6*a* and the cover 6*b* of the traveler device 6 as illustrated in FIG. 6, they can freely rotate within said traveler device 6. Besides, anti-slip rings 19, 20 are arranged in such a manner that their outer extreme lateral ends are partially exposed to the outside of the traveler device 6 through respective openings (not shown) arranged at the top and bottom of the cover 6*b* and therefore separably located on the inner surfaces 3*b*, 3*b* of the round conduits 3*a*, 3*a* of said fixed rail, or the surfaces on which the steel balls are revolved.

Figure 8:
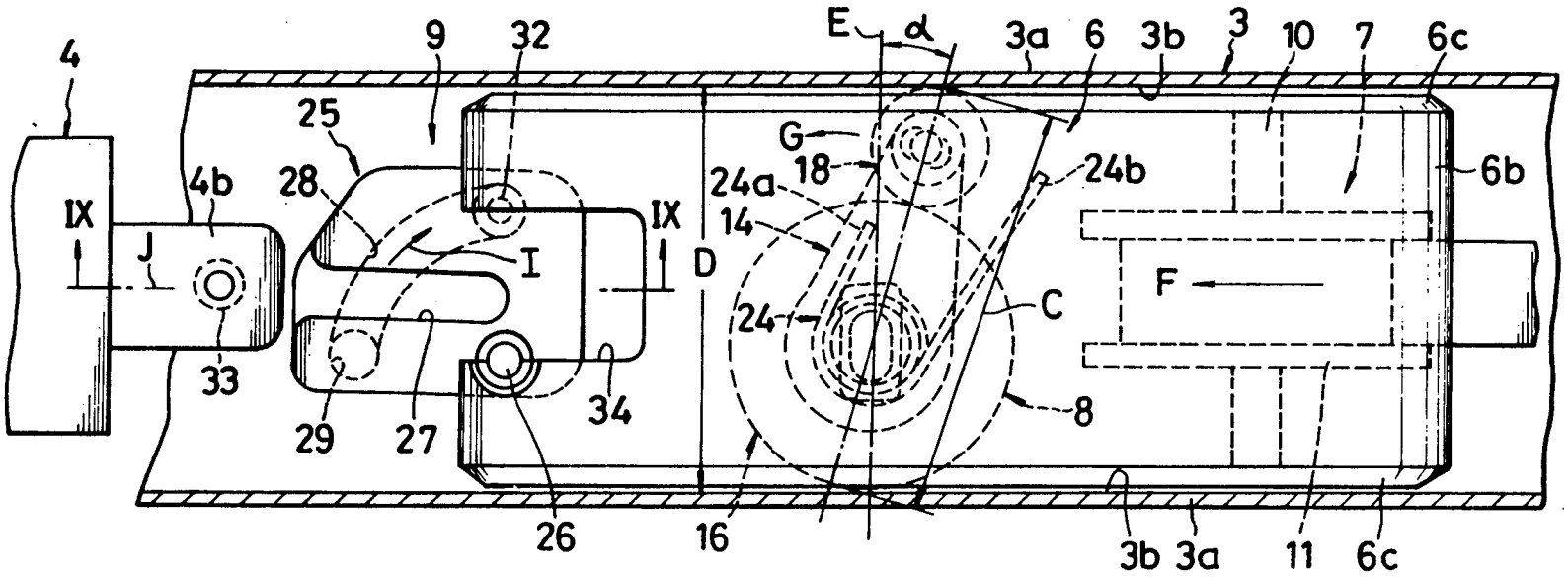
FIG. 8 is a partial side view of the embodiment illustrating how the traveler device and the sliding rail are separate from each other.

As seen from FIG. 8, the rollers 16 and 18 are so designed that the sum C of the diameters of the rollers 16 and 18 is greater than the distance between the opposite conduits 3*b*, 3*b* of said fixed rail by a given amount so that the line connecting the centers of the rollers 16 and 18 is inclined by angle a from a line E perpendicular to the fixed rail 3 and the center of the roller 18 of the smaller diameter is found slightly behind that of the other roller 16.

Thus, when the traveler device 6 is pulled out in the direction indicated by arrow F, said roller 18 goes into the opposite direction relative to the roller 16 so that the extreme lateral ends of the rollers 16 and 18 stay frictionlessly in contact with the corresponding inner surfaces 3*b*, 3*b* of the round conduits 3*a*, 3*a* of the fixed rail, while, on the other hand, when the roller 18 with the smaller diameter is moved in the direction indicated by arrow G, the extreme lateral ends of the rollers 16 and 18 are strongly pressed against the corresponding inner surfaces 3*b*, 3*b* to cause friction therebetween, when the traveler is pulled back into the compartment, or in the direction opposite to that of arrow F, by said resilient force.

Now, if the catch 14 is urged in the direction of arrow G of FIG. 8 by a spring 24 having an end 24*a* secured to said catch 14 itself and the other end 24*b* to the traveler device 6, sufficient friction between the rollers 16, 18 and the corresponding inner surfaces 3*b*, 3*b* will be securely guaranteed by the spring 24 whenever the traveler device 6 is moved in the direction opposite to that of arrow F.

The larger diameter roller 16 comprises an inverted cup-shaped roller cylinder 16*a* for rotatably receiving a rotary shaft 16*b*, which is rigidly fitted to a roller lid 16*d* with interposition of an O-ring 16*c* therebetween, the space between said roller cylinder 16*a* and said roller shaft 16*b* being filled with a highly viscous fluid H' to form a damper H and to generate a viscous drag there so that, when the traveler device 6 is pulled back into the compartment (in the direction opposite to arrow F), said damper H tries to dampen the pulling force of the spring means 7 by the viscous drag.

As described earlier, said roller cylinder 16*a* is provided on its outer periphery with a anti-slip ring 19 so that the roller 16 is frictionally rotated with the smaller diameter roller 18 when the two rollers are in contact with each other. Said roller shaft 16*b* and said roller lid 16*d* are rigidly secured to the main body 6*a* of the traveler device 6 by means of said machine bolt 21.

Said lock device 9 has a configuration as described below.

As illustrated in FIGS. 5, 6, 8 and 9, there is provided a substantially rectangular lock plate 25, which is rotatable by approximately 90° in the plane of the plate around a pivot 26 located near one of its corners and supported on the upper surface of the main body 6*a* of the traveler device 6 near the front edge thereof.

Said lock plate 25 is provided with a longitudinal groove 27 running at the middle on the upper surface and having an open front end. It is also provided with a curved groove 28 around said pivot 26 to from an imaginary sector with a central angle of approximately 90°, a round detent recess 29 being formed at an end of said curved groove 28.

On the other hand, a through bore 30 runs through the main body 6*a* of the traveler device 6 near its front end and also near the lateral side opposite to that of the pivot 26. Besides, a round detent 31 is formed on the fixed rail 3 at a position where it comes to face vis-a-vis said through bore 30 when the traveler device 6 is pulled out to a desired position with the drawer 2.

A revolvable latch detent element 32 in the form of a ball or a roller is housed in said through bore 30 and vertically movable.

Said through bore 30 has a depth or vertical length smaller than the diameter of said revolvable latch detent element 32 and greater than its half-diameter so that said revolvable latch detent element 32 is partly and constantly found in said through bore 32 and partly located either in said detent recess 29 of the lock plate 25 or in said detent 31 of said fixed rail 3.

Figure 9:
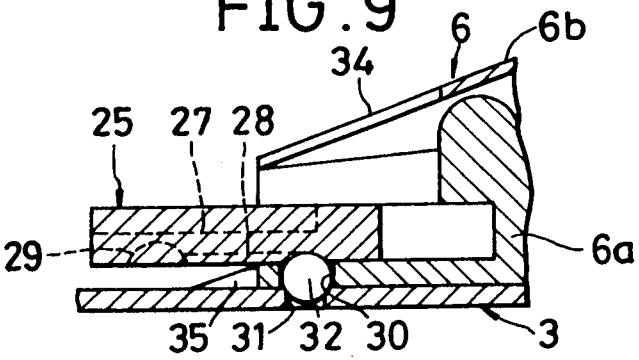
FIG. 9 is a sectional view cut along IX—IX line of FIG. 8.

The round detent 31 may be alternatively realized in the form of a through bore as illustrated in FIG. 9 so long as the diameter of the bore 31 is made appropriately smaller than that of the revolvable latch 32 so that the lower portion of the revolvable latch 32 may be received in said bore 31 only to a desired extent.

Figure 5:
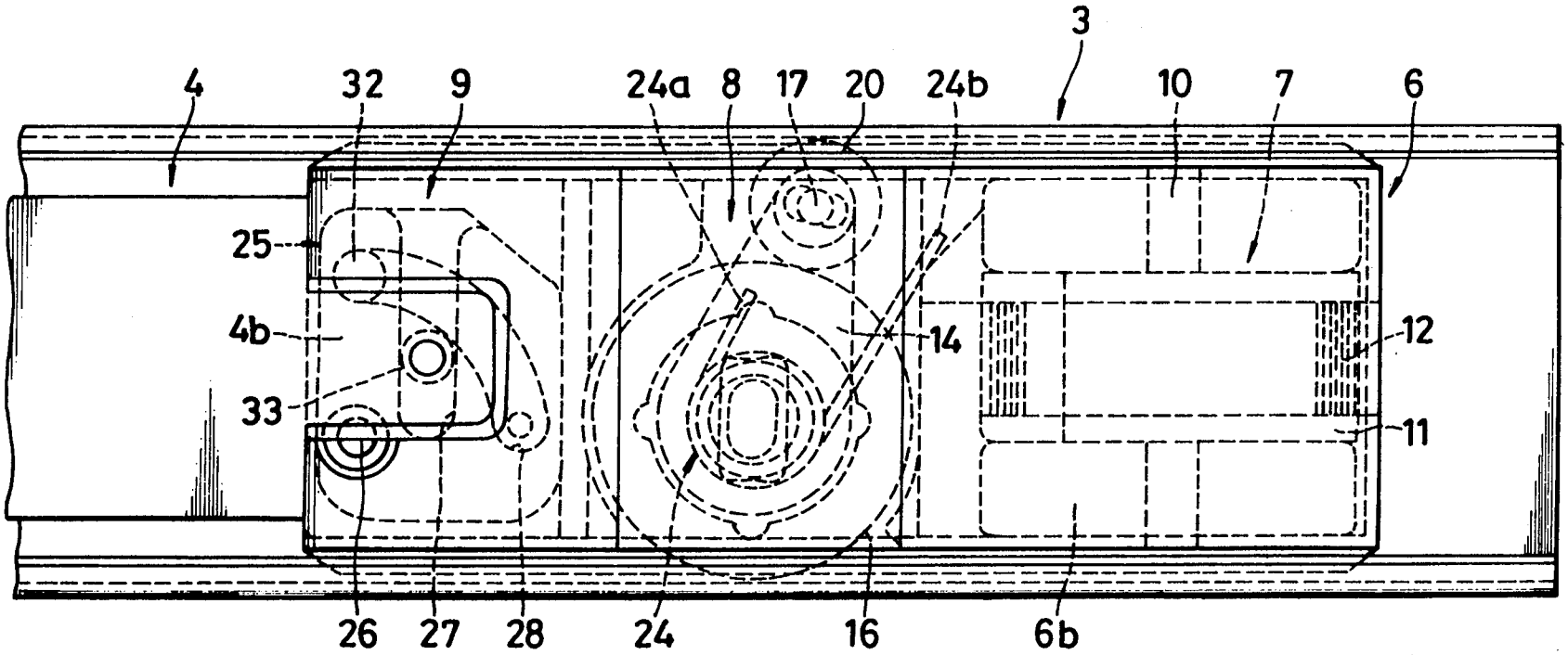
FIG. 5 is a partial side view of the embodiment illustrating how the traveler device and the sliding rail are coupled together.

The lock plate 25 may be rotated around the pivot 26 from a position where it is completely housed in the traveler device 6 as shown in FIG. 5 to a position where it is swung out toward the front as illustrated in FIG. 8, where a hook pin 33 projecting from the rear end of the sliding rail 4 is received by the longitudinal groove 27 of the lock plate 25. The longitudinal groove 27 is inclined relative to the center line J of the hook pin 33 by an appropriate angle in order to facilitate engagement and disengagement of the groove 27 and the pin 33 and cause 90° rotation of the lock plate 25 in the sense of arrow I upon movement of the pin 33 to the closed end of groove 27 and in the opposite direction upon movement of pin 33 from the closed end of groove 22 outwardly of the open end thereof.

As said hook pin 33 is arranged on an extension 4*b* of the sliding rail 4 extending rearward from the latter, a tilted U-shaped notch 34 is formed at the middle of the front end of the cover 6*b* of said traveler device 6 so that said extension 4*b* may be received by the traveler device 6 when the sliding rail 4 and the traveler device 6 are connected with each other.

A stopper 35 projects from the fixed rail 3 at a desired position as shown in FIGS. 6 and 9 to halt the traveler device there.

The spring means 7 does not necessarily comprise a constant load spring 12, as a simple coil spring may be used in its place.

As is apparent from the above detailed description relative to a preferred embodiment of the invention, since both the movable member and the traveler device are separated from each other and coupled together respectively by the force pulling out the movable member and the force pushing it into the fixed member and, at the same, time they are locked to and released from the fixed rail on which the traveler device is arranged, the movable member can be removed out of the fixed member and restored on to it whenever the traveler device is located at a predetermined position without requiring any particular operation. Moreover, whenever the movable member is pushed into the fixed member and coupled with the traveler device, the lock device holding the movable member is unlocked to release the latter so that the movable member can thereafter automatically travel along the fixed rail as it is pulled by the spring means. At the same time, since the two rollers of the travel controller are frictionally rotated on the oppositely arranged inner surfaces of the rounded conduits of the fixed rail, if the travel controller is given the function of a damper that dampens the movement of the rollers in one direction by filling the space between the roller cylinder and the rotary shaft with a viscous liquid to utilize the viscous shearing drag of the liquid, the movable member will lightly travel along the fixed rail when it is pulled out and, to the contrary, slowly but smoothly move when it is pulled back by said spring means. If a lock means is appropriately arranged, the movable member can be automatically operated within a predetermined range.

What is claimed is:

1. A mechanism for controlling the travel of a movable structural member along rails, said mechanism comprising a fixed member provided with a pair of fixed rails, a pair of sliding rails engaged with the respective fixed rails and a movable member arranged on said sliding rails, a pair of traveler devices connected to said sliding rails and engaged with the respective fixed rails for movement therealong, a pair of spring means connected between said fixed member and said traveler devices for pulling the respective traveler devices in a given direction along said fixed rails, a pair of travel controllers mounted on said sliding rails each comprising at least two rollers, the outer peripheries of said rollers being frictionally contacted with each and oppositely facing surfaces of the corresponding fixed rail, a pair of lock devices including first and second operational modes and operatively associated with said traveler devices, said fixed rails and said movable member and operative, when in said first operational mode, to prevent movement of said movable member relative to said traveler devices, and further operative to shift to said second operational mode upon movement of said traveler devices in said opposite direction relative to said fixed rails to predetermined positions in said opposite direction and release said movable member for movement thereof relative to said traveler devices in said opposite direction and also operative, upon subsequent movement of said movable member in said given direction relative to said traveler devices, to shift to said first operational mode to lock said movable member to said traveler devices for movement therewith in said given direction and release said traveler devices from said fixed rails for movement therealong under the biasing action of said spring means in said given direction, said lock devices each comprising a lock plate releasably coupled with the corresponding sliding rail for angularly displacement about a pivot axis stationary with said corresponding sliding rail, said lock devices including means operative to securely hold the respective traveler devices to the fixed rails responsive to rotation of said lock plates at the time of coupling with the respective sliding rails, said rollers being movably mounted from said travel controllers and biased against said oppositely facing surfaces with sufficient friction generated therebetween to cause the travel controllers to function as dampers that dampen the biasing action of the spring means only when the traveler devices are pulled back into the fixed member as the sum of the diameters of the two rollers is so determined that it is greater than the distance between the oppositely facing surfaces of the fixed rails.

2. The mechanism of claim 1 wherein said lock plates each include a selectively releasable and engageable positive detent connection with said fixed rails, said detent connections being in the engaged position when said lock devices are in said operational mode and in the release position when said lock devices are in said second operational mode.

3. The mechanism of claim 1 wherein one of said rollers includes rotation retarding means operatively associated therewith to yieldingly retard rotation thereof.

* * * * *